US006595761B2

(12) United States Patent
Otsuka et al.

(10) Patent No.: US 6,595,761 B2
(45) Date of Patent: Jul. 22, 2003

(54) SCREW COMPRESSOR

(75) Inventors: Kaname Otsuka, Settsu (JP); Hiroyuki Yoneda, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/958,887

(22) PCT Filed: Jan. 26, 2001

(86) PCT No.: PCT/JP01/00511

§ 371 (c)(1),
(2), (4) Date: Dec. 12, 2001

(87) PCT Pub. No.: WO01/61194

PCT Pub. Date: Aug. 23, 2001

(65) Prior Publication Data

US 2002/0136647 A1 Sep. 26, 2002

(30) Foreign Application Priority Data

Feb. 17, 2000 (JP) ..... 2000-39453

(51) Int. Cl.[7] ..... F04B 17/00
(52) U.S. Cl. ..... 417/410.3; 417/359; 418/201.1
(58) Field of Search ..... 417/410.3, 410.4, 417/359, 360; 418/201.1

(56) References Cited

U.S. PATENT DOCUMENTS 3,850,551 A * 11/1974 Gamache et al. ..... 417/410.3
4,547,135 A * 10/1985 Noel et al. ..... 417/360
4,589,826 A * 5/1986 Zimmern et al. ..... 184/6.11
6,287,088 B1 * 9/2001 Nishimura et al. ..... 417/297

FOREIGN PATENT DOCUMENTS

| | | |
|---|---|---|
| JP | A54-154811 | 12/1979 |
| JP | A56-165790 | 12/1981 |
| JP | 56-165790 | * 12/1981 |
| JP | 64-46489 | * 3/1989 |
| JP | A11-13674 | 1/1999 |

* cited by examiner

*Primary Examiner*—Charles G. Freay
*Assistant Examiner*—Michael K. Gray
(74) *Attorney, Agent, or Firm*—Birch, Stewart, Kolasch & Birch, LLP

(57) ABSTRACT

There is provided a screw compressor which needs neither a bed nor a coupling, therefore not involving alignment, and yet in which gas is not heated by the motor. The screw compressor has a compression section 21 and a motor section 22 inside a casing 20. Both a rotor 27 of a motor 23 and a screw 26 of the compression section 21 are fixed to one main shaft 25. The main shaft 25 is supported at three points by a total of three bearings of both-end rolling bearings 31, 32 and a central rolling bearing 33. A refrigerant passage 45 passes only through the compression section 21 and not through the motor section 22.

4 Claims, 2 Drawing Sheets

SCREW COMPRESSOR

This application is the national phase under 35 U.S.C. §371 of PCT International Application No. PCT/JP01/00511 which has an International filing date of Jan. 26, 2001, which designated the United States of America.

TECHNICAL FIELD

The present invention relates to a screw compressor for compressing a gas such as a refrigerant.

BACKGROUND ART

Semi-closed type screw compressors have been widely used recently. This semi-closed type screw compressor is so constructed that a motor section and a compression section are placed in a casing, with a motor shaft of the motor section and a screw shaft of the compression section provided as an integral unit, where the refrigerant is sucked into a compression section through the motor section.

However, in this semi-closed type screw compressor, since the refrigerant is sucked into the compression section through the motor section, the refrigerant is heated by the motor, causing a problem of deteriorated efficiency.

Therefore, such an open type screw compressor as shown in FIG. 2 is reviewed. This open type screw compressor assembly is so constructed that a motor 2 and a screw compressor 3 are mounted on a large-sized bed 1, while a shaft 2*a* of the motor 2 and a shaft 3*a* of the screw compressor 3 are coupled to each other with a coupling 5.

However, in this open type screw compressor, since the motor 2 and the screw compressor 3 are provided as completely separate units, the large-sized bed 1 and the coupling 5 are involved while the alignment between the shaft 2*a* of the motor 2 and the shaft 3*a* of the screw compressor 3 takes man-hours, thus resulting in a problem of quite high costs.

DISCLOSURE OF THE INVENTION

Accordingly, an object of the invention is to provide a screw compressor in which the needs for the bed and the coupling are eliminated, therefore the need for alignment being also eliminated, and yet in which the gas is not heated by the motor.

In order to achieve the above object, in a first aspect of the invention, there is provided a screw compressor in which a compression section and a motor section are placed in a casing, comprising:

- a gas passage passing only through the compression section; and
- a main shaft to which a rotor of the motor section and a screw of the compression section are fixed.

In this screw compressor of the first aspect of the invention, since the compression section and the motor section are placed inside the casing, the casing plays the role of a bed, eliminating the need for the bed. Further, since both the rotor of the motor section and the screw of the compression section are fixed to one main shaft, the need for the coupling of the prior art is eliminated, so that the man-hour for alignment is eliminated. As a consequence, this screw compressor can be manufactured with low cost and can be installed simply.

Further, since the gas passage passes only through the compression section and not through the motor section, gas is never heated by the motor of the motor section. As a consequence, this screw compressor is good at compression efficiency.

In one embodiment, the main shaft is supported at three points by bearings provided at three sites of an end portion of the motor section, an end portion of the compression section and a site between the motor section and the compression section.

According to this embodiment, since the main shaft is three-point supported by the bearings provided at the three points, the number of rolling bearings involved is reduced and the assembly is also facilitated. As a consequence, this screw compressor can be manufactured with low cost.

In one embodiment, a motor-cooling air passage is provided in the casing and air blown by a fan that is driven by a motor of the motor section passes through the motor-cooling air passage.

According to this embodiment, the air blown by the fan passes through the motor-cooling air passage to cool the motor. As a consequence, coils of the motor can be prevented from elevating in temperature.

In a second aspect of the invention, there is provided a screw compressor comprising:

- a casing which is internally partitioned into a first chamber and a second chamber opposed to each other;
- a screw type compression section placed in the first chamber;
- a motor section placed in the second chamber and having a motor for driving the compression section;
- a gas passage defined in the first chamber and allowing a gas to flow from an inlet only through the compression section to an outlet; and
- a motor-cooling air passage defined in the second chamber and allowing air to pass from an inlet only through the motor section to an outlet, wherein
- the gas passage and the motor-cooling air passage are independent from each other, and
- a main shaft to which a rotor of the motor is fixed has an extended portion axially extended, and the screw of the compression section is fixed to the extended portion.

According to the screw compressor of the second aspect of the invention, since the compression section and the motor section are placed in the first chamber and the second chamber, respectively, defined in the casing, the casing plays the role of a bed, eliminating the need for the bed. Also, since both the rotor of the motor section and the screw of the compression section are fixed to one main shaft, the need for the coupling of the prior art is eliminated, so that the man-hour for alignment is also eliminated. As a consequence, this screw compressor can be manufactured with low cost, and can be installed simply.

Further, since the gas passage passes only through the compression section and not through the motor section, gas is never heated by the motor of the motor section. As a consequence, this screw compressor is good at compression efficiency.

One embodiment further comprises a fan driven by the motor provided at a vicinity of the inlet of the motor-cooling air passage, wherein air blown by the fan is allowed to flow to the motor-cooling air passage.

According to this embodiment, the air blown by the fan passes through the motor-cooling air passage to cool the motor. As a consequence, coils of the motor can be prevented from elevating in temperature.

In one embodiment, the screw of the compression section is a single screw.

BEST MODE FOR CARRYING OUT THE INVENTION

Hereinbelow, the present invention is described in detail by way of an embodiment thereof illustrated in the accompanying drawings.

Figure 1:
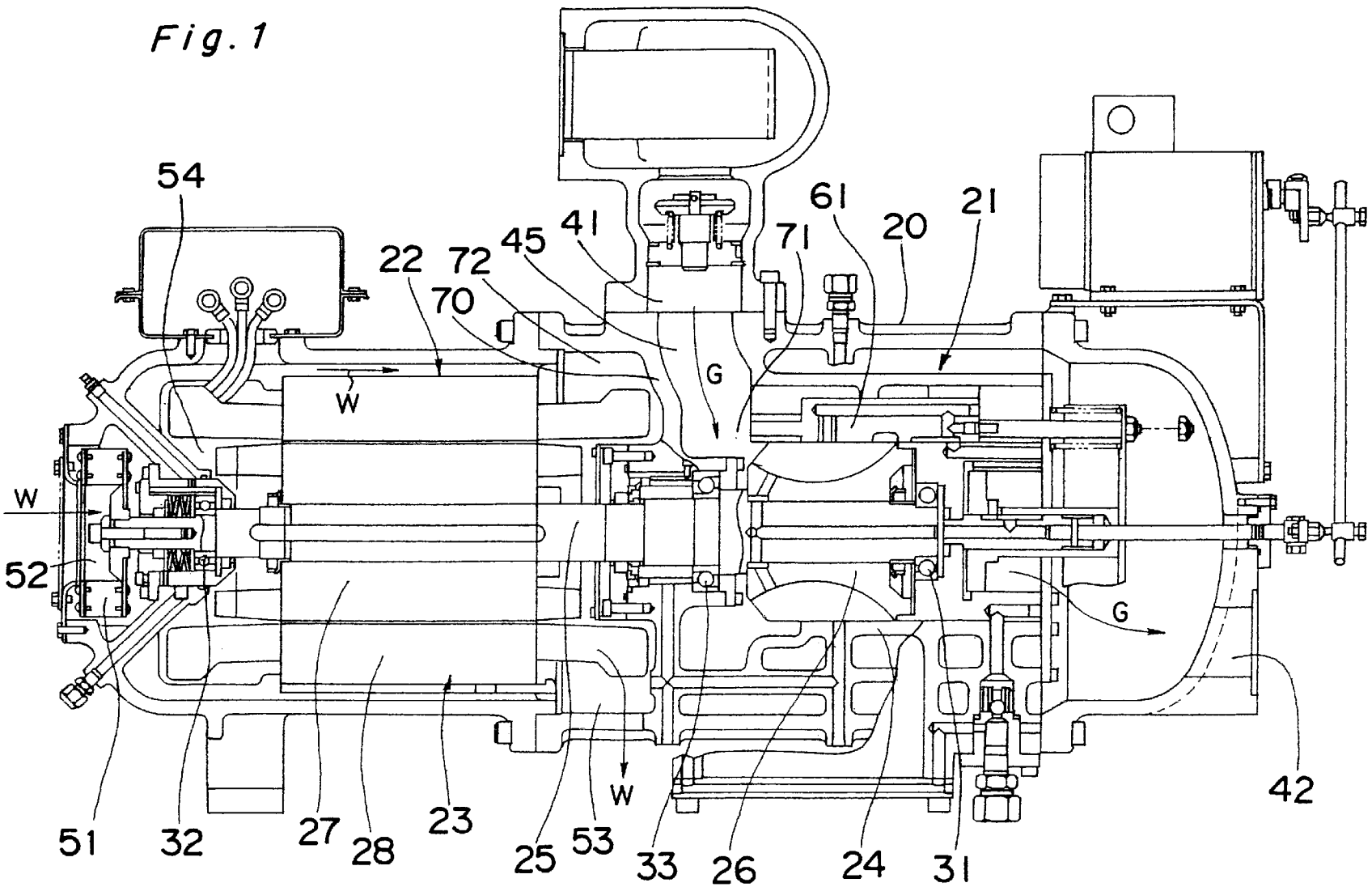
FIG. 1 is a sectional view of a screw compressor according to an embodiment of the invention.
Figure 2:
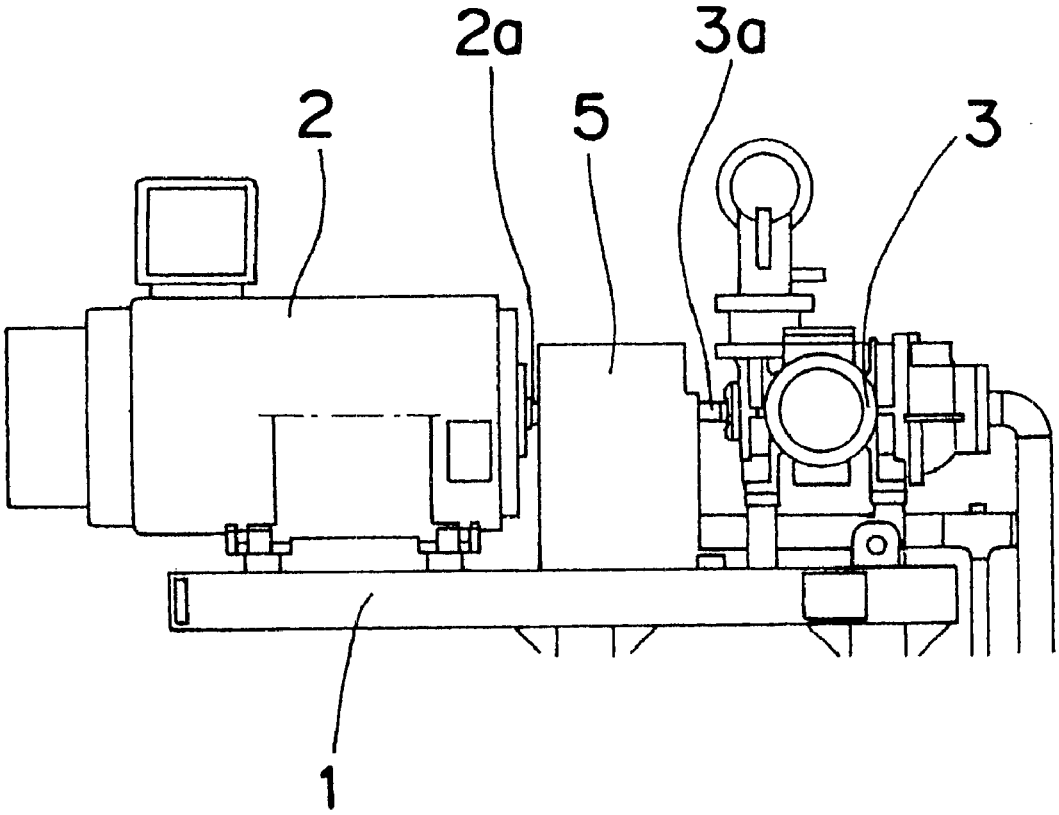
Fig. 2 PRIOR ART
FIG. 2 is a front view of a screw compressor assembly according to the prior art.

As shown in FIG. 1, this screw compressor has a casing 20 partitioned by a partitioning wall 70 into a first chamber 71 and a second chamber 72 opposed to each other. A compression section 21 is placed in this first chamber 71, and a motor section 22 is placed in the second chamber 72, respectively. In the compression section 21, a screw 26 fixed to an end portion of a main shaft 25 is rotatably fitted into a cylinder 24 formed integral with the casing 20. A rotor 27 of a motor 23 in the motor section 22 is fixed at the other end portion of the main shaft 25. That is, the main shaft 25 to which the rotor 27 is fixed has an axial extended portion, to which extended portion the screw 26 is fixed. A stator 28 of the motor 23 is fixed to the casing 20.

The main shaft 25 is supported at three points of both ends and a center thereof. More specifically, an outer end side of the screw 26 of the main shaft 25 is supported by a rolling bearing 31, an outer end side of the rotor 27 of the motor 23 of the main shaft 25 is supported by a rolling bearing 32, and the main shaft 25 is supported by a rolling bearing 33 between the motor section 22 and the compression section 21.

Also, the first chamber 71 of the casing 20 includes an inlet 41 and an outlet 42, as well as a refrigerant passage 45 as a gas passage for communicating the inlet 41 and the outlet 42 with each other. This refrigerant passage 45 passes only through the compression section 21, and not through the motor section 22, making the refrigerant gas flow as shown by arrows G.

Also, a fan 51 is fixed at an end portion of the main shaft 25 on the motor section 22 side. In the second chamber 72 of the casing 20, a motor-cooling air passage 54 is formed so as to extend from an inlet 52 to an outlet 53, so that the cooling air blown by the fan 51 located near the inlet 52 flows as shown by an arrow W, thereby cooling the motor 23. The refrigerant passage 45 and the motor-cooling air passage 54 are independent from each other. It is noted that reference numeral 61 denotes a slide valve.

In this constitution, as the main shaft 25 rotates, the refrigerant gas is compressed between the cylinder 24 and the screw 26 in the compression section 21, flowing through the refrigerant passage 45 as shown by the arrow G in FIG. 1. In this operation, since the refrigerant passage 45 passes only through the compression section 21 and not through the motor section 22, the refrigerant gas is never heated by the motor 23 of the motor section 22. As a consequence, this screw compressor is good at compression efficiency.

Also, the air blown by the fan 51 that is driven by the motor 23 passes through the motor-cooling air passage 54 as shown by the arrow W, thereby cooling the rotor 27 and the stator 28 of the motor 23. As a consequence, coils of the rotor 27 and the stator 28 of the motor 23 can be prevented from elevating in temperature, so that the reliability can be improved.

In this screw compressor, since the compression section 21 and the motor section 22 are placed in the casing 20, the casing 20 itself plays the role of a bed, eliminating the need for a bed.

Further, since both the rotor 27 of the motor 23 and the screw 26 of the compression section 21 are fixed to one main shaft 25, the need for the coupling is eliminated, so that the man-hour for alignment is eliminated. As a consequence, this screw compressor can be manufactured with low cost and can be installed simply.

Further, since the main shaft 25 is supported at three points by a total of three rolling bearings, the both-end rolling bearings 31, 32 and the central rolling bearing 33, the necessary number of rolling bearings can be reduced and the assembly is also facilitated, as compared with the conventional case of four-point support. As a consequence, this screw compressor can be manufactured with low cost.

Whereas the above embodiment has been exemplified by a single screw compressor, the present invention may also be applied to double screw compressors. In the case of a double screw compressor, although two main shafts are employed, yet the case is the same in that both rotor and screw are fixed to each shaft.

Also, although the screw 26 provided separately from the main shaft 25 is fixed to this main shaft 25 in the above embodiment, the screw may also be formed integrally with the main shaft. In this case also, it is described herein that the screw is fixed to the main shaft.

Although the main shaft 25 is supported by the rolling bearings 31, 32, 33 in the above embodiment, the main shaft 25 may also be supported by plain bearings.

Further, although the screw compressor of the above embodiment is used to compress the refrigerant, yet the screw compressor of the present invention may be used for the compression of gases such as air, oxygen and nitrogen without being limited to refrigerants.

As apparent from the above description, since the compression section and the motor section are placed inside the casing, the casing plays the role of a bed, eliminating the need for the bed. Further, since both the rotor of the motor section and the screw of the compression section are fixed to one main shaft, the need for the coupling of the prior art is eliminated, so that the man-hour for alignment is eliminated. As a consequence, this screw compressor can be manufactured with low cost and can be installed simply.

Also, according to the screw compressor of one embodiment, since the gas passage passes only through the compression section and not through the motor section, gas is never heated by the motor of the motor section. As a consequence, this screw compressor is good at compression efficiency.

Also, according to the screw compressor of one embodiment, since the main shaft is three-point supported by the bearings provided at the three points, the number of rolling bearings involved is reduced and the assembly is also facilitated. As a consequence, this screw compressor can be manufactured with low cost.

Also, according to the screw compressor of one embodiment, since air blown by the fan that is driven by the motor passes through the motor-cooling air passage to cool the motor, coils of the rotor and the stator of the motor can be prevented from elevating in temperature, so that the motor reliability can be improved.

What is claimed is:

1. A screw compressor in which a compression section (21) and a motor section (22) are placed in a casing (20), comprising:

a gas passage (45) passing only through the compression section (21); and a main shaft (25) to which a rotor (27) of the motor section (22) and a screw (26) of the compression section (21)

are fixed, wherein a motor-cooling air passage (54) is provided in the casing (20), an air blown by a fan (51) passes through the motor-cooling air passage (54) only through the motor section (22), the gas passage (45) and the motor-cooling air passage (54) not interfering with each other.

2. The screw compressor according to claim 1, wherein the main shaft (25) is supported at three points by bearings (32, 31, 33) provided at three sites of an end portion of the motor section (22), an end portion of the compression section (21) and a site between the motor section (22) and the compression section (21).

3. A screw compressor comprising:

a casing (20) which is internally partitioned into a first chamber (71) and a second chamber (72) opposed to each other;

a screw type compression section (21) placed in the first chamber (71);

a motor section (22) placed in the second chamber (72) and having a motor (23) for driving the compression section (21);

a gas passage (45) defined in the first chamber (71) and allowing a gas to flow from an inlet (41) only through the compression section (21) to an outlet (42);

a fan (51) driven by the motor (23); and a motor-cooling air passage (54) defined in the second chamber (72) and allowing air blown by the fan (51) to pass only through the motor section (22), wherein:

the gas passage (45) and the motor-cooling air passage (54) do not interfere with each other, and a main shaft (25) to which a rotor (27) of the motor (23) is fixed has an extended portion axially extended, and the screw (26) of the compression section (21) is fixed to the extended portion.

4. The screw compressor according to claim 3, wherein the screw (26) of the compression section (21) is a single screw.

* * * * *